US005758018A

United States Patent [19]

Fowler, Jr.

[11] Patent Number: 5,758,018

[45] Date of Patent: May 26, 1998

[54] POWER STEAM HUMIDIFIER

[75] Inventor: James M. Fowler, Jr., Houston, Tex.

[73] Assignee: American Metal Products Co., Olive Branch, Miss.

[21] Appl. No.: 768,902

[22] Filed: Dec. 17, 1996

Related U.S. Application Data

[63] Continuation of Ser. No. 411,128, Mar. 27, 1995.

[51] Int. Cl.[6] ..... F24F 3/14; F24B 1/30

[52] U.S. Cl. ..... 392/402; 392/326; 392/333

[58] Field of Search ..... 392/386, 401, 392/402, 324, 325, 326, 327, 333, 334–337

[56] References Cited

U.S. PATENT DOCUMENTS

| | | | |
|---|---|---|---|
| 3,452,059 | 6/1969 | Babington . | |
| 3,472,496 | 10/1969 | Coleman et al. . | |
| 3,570,472 | 3/1971 | Santangelo . | |
| 3,776,215 | 12/1973 | Howard et al. . | |
| 3,840,001 | 10/1974 | Ernest . | |
| 3,855,371 | 12/1974 | Morrow et al. . | |
| 3,856,279 | 12/1974 | Yeagle . | |
| 3,987,133 | 10/1976 | Andra | 392/402 |
| 3,990,427 | 11/1976 | Clinebell . | |
| 4,139,762 | 2/1979 | Pohrer et al. . | |
| 4,146,775 | 3/1979 | Kirchner et al. | 392/327 |
| 4,200,598 | 4/1980 | Yeagle . | |
| 4,239,956 | 12/1980 | Morton . | |
| 4,262,191 | 4/1981 | Lepper et al. | 392/327 |
| 4,354,985 | 10/1982 | Johnson . | |
| 4,361,273 | 11/1982 | Levine et al. . | |
| 4,499,031 | 2/1985 | Sexton et al. . | |
| 4,595,139 | 6/1986 | Levine . | |
| 4,612,434 | 9/1986 | Ianitelli et al. . | |
| 4,675,505 | 6/1987 | Fischer | 392/327 |
| 4,841,122 | 6/1989 | Marton | 392/327 |
| 4,986,937 | 1/1991 | Sorio . | |
| 5,131,589 | 7/1992 | Sherrill . | |
| 5,252,260 | 10/1993 | Schuman . | |
| 5,467,424 | 11/1995 | Davies et al. | 392/401 |

*Primary Examiner*—Teresa J. Walberg
*Assistant Examiner*—Sam Paik
*Attorney, Agent, or Firm*—Edgar A. Zarins; Malcolm L. Sutherland

[57] ABSTRACT

A power humidifier which supplies steam humidity to the air flow of a furnace system. Heater elements within a water reservoir heat the water to create steam supplied to the air flow. The humidifier is controlled by a microprocessor to ensure efficient operation while monitoring operating characteristics to prevent damage to the humidifier. The microprocessor ensures that the reservoir fills properly, the water level does not fall below the heating element, and that the unit does not overheat during operation.

14 Claims, 6 Drawing Sheets

POWER STEAM HUMIDIFIER

This application is a continuation of copending application Ser. No. 08/411,138 filed on Mar. 27, 1995.

BACKGROUND OF THE INVENTION

I. Field of the Invention

This invention relates to a steam humidifier for supplying steam humidity to the air flow of a furnace system and, in particular, to a steam humidifier which is controlled by a microprocessor circuit to ensure efficient and reliable operation.

II. Description of the Prior Art

It is well known that supplying moisture to the air flow of a furnace system can enhance living conditions. Heated air from a furnace typically is very dry leading to personal discomfort, static electricity and damage to household furnishings. A multitude of systems have been developed over the years for increasing the humidity in a living area. While room humidifiers can have value, humidifiers which mount to a furnace system to add moisture to the air flow are most efficient for improving living conditions. Examples of prior known furnace mount humidifiers include bypass systems which redirect airflow through or over a moisture media, blower-type which force moisture ladened air into the furnace system, and steam humidifiers which boil water to create steam supplied to the air flow.

Steam humidifiers provide a very efficient means of increasing the humidity of the air. As opposed to other humidifying systems which attempt to extract moisture from cold water, the steam humidifier supplies hot steam to the warm air flow of the furnace. The air flow is therefore not cooled by the water facilitating a higher moisture content. However, because steam humidifiers utilize a heating element to create the steam such humidifiers are prone to breakdowns. In the event the water level falls below the heating element, the unit can overheat reducing the operating life of the humidifier. Furthermore, many steam humidifiers operate continuously which can be a waste of electricity or may energize only after the furnace has cycled resulting in considerable lead time before steam is generated.

SUMMARY OF THE PRESENT INVENTION

The present invention overcomes the disadvantages of the prior known steam humidifiers by providing a microprocessor controlled steam humidifier for a furnace system which ensures efficient and reliable operation.

The power steam humidifier of the present invention includes a water reservoir extending from a front control panel. The control panel includes a peripheral flange for securing the humidifier to the furnace duct with the water reservoir positioned within the duct in order to add moisture to the air flowing through the duct. A heating element within the reservoir heats the water to create steam. The reservoir is also provided with means to deliver and drain water and probes to sense the water level and temperature.

The control panel incorporates a microprocessor and circuit board to determine and control operating characteristics such as cycle time, temperature, water level and any possible malfunctions. Indicator lights on the control panel provide a visual means of determining the state of the humidifier. The circuit board incorporates independent circuits to sense operating characteristics of the humidifier and communicate such characteristics to a microprocessor to determine the sequential operation of the humidifier which also control the indicator lights. The microprocessor is loaded with a logic program to carry out the proper inquiries and controls for efficient and reliable operation of the power steam humidifier.

Other objects, features, and advantages of the invention will be apparent from the following detailed description taken in connection with the accompanying drawings.

BRIEF DESCRIPTION OF THE DRAWING

The present invention will be more fully understood by reference to the following detailed description of a preferred embodiment of the present invention when read in conjunction with the accompanying drawing, in which like reference characters refer to like parts throughout the views and in which.

DETAILED DESCRIPTION OF A PREFERRED EMBODIMENT OF THE PRESENT INVENTION

Figure 1:
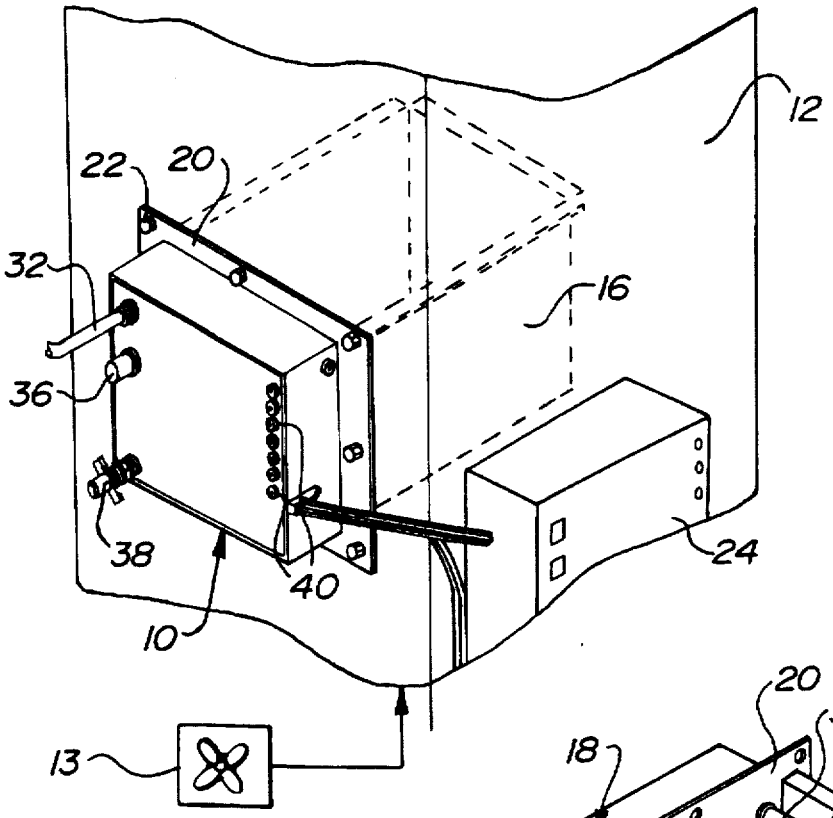
FIG. 1 is a perspective view of a power steam humidifier of the present invention mounted to a furnace.
Figure 2:
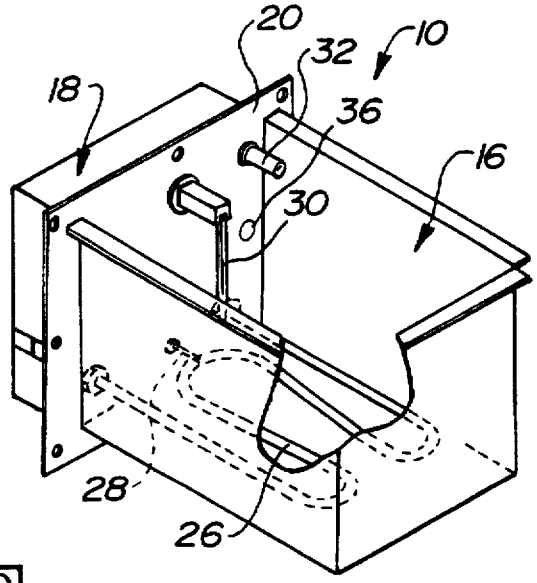
FIG. 2 is a reverse perspective view of the power steam humidifier.
Figure 3:
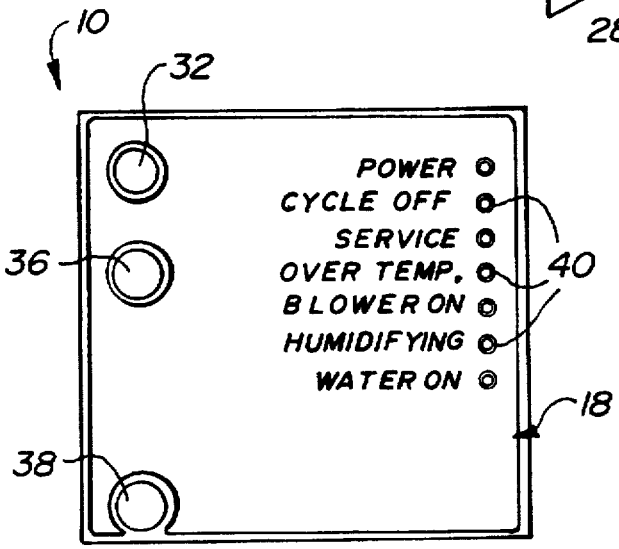
FIG. 3 is a front elevational view thereof.

Referring first to FIGS. 1 trough 4, there is shown a power steam humidifier 10 embodying the present invention. In the preferred application, the humidifier 10 would be mounted on a warm air duct 12 of a furnace in order to add moisture to the heated air being forced through the furnace. The humidifier 10 may be mounted to a return or cool air duct to add moisture to the air flow before it is heated. A water reservoir 16 of the humidifier is disposed within the furnace duct 12 in the path of the air flow from blower fan 13. The reservoir 16 is connected to a control housing 18 disposed outside the duct 12 and including a perimeter flange 20 for mounting the humidifier 10 to the furnace duct 12 using standard fasteners 22. Although not absolutely necessary, the humidifier 10 may be electronically connected to a humidistat 24 which monitors the moisture level within the air flowing through the system to maintain proper humidity levels.

Positioned within the reservoir 16 near the bottom is a heating element 26 to raise the temperature of the water in the reservoir 16 and a temperature probe 28 for measuring the temperature of the water. Also disposed within the reservoir is a water level probe 30 and a water inlet 32. Secured to the water level probe 30 is a shield 31 to reduce mineral build-up on the surfaces of the probe insulator 7. Mineral build-up can cause the insulator 7 of the probe 30 to become electronically conductive resulting in the reservoir 16 not correctly filling. Each of these elements is electronically connected to and monitored by the control housing 18 as will be subsequently described. The heating element 26 is activated to heat the water to create steam while the temperature probe 28 monitors water temperature to control the cycle time of the furnace blower. Similarly, the water level probe 20 monitors the water level within the reservoir 16 to deactivate a fill valve 34 which controls water flow through the inlet 32 into the reservoir 16. At the end of a predetermined boiling period, the fill valve 34 opens until the water level reaches water sensing probe. This ensures that the heating element 26 is always immersed in water and that the reservoir 16 does not overflow. An overflow tube 36 is provided to direct any overflow to a drain.

Figure 4:
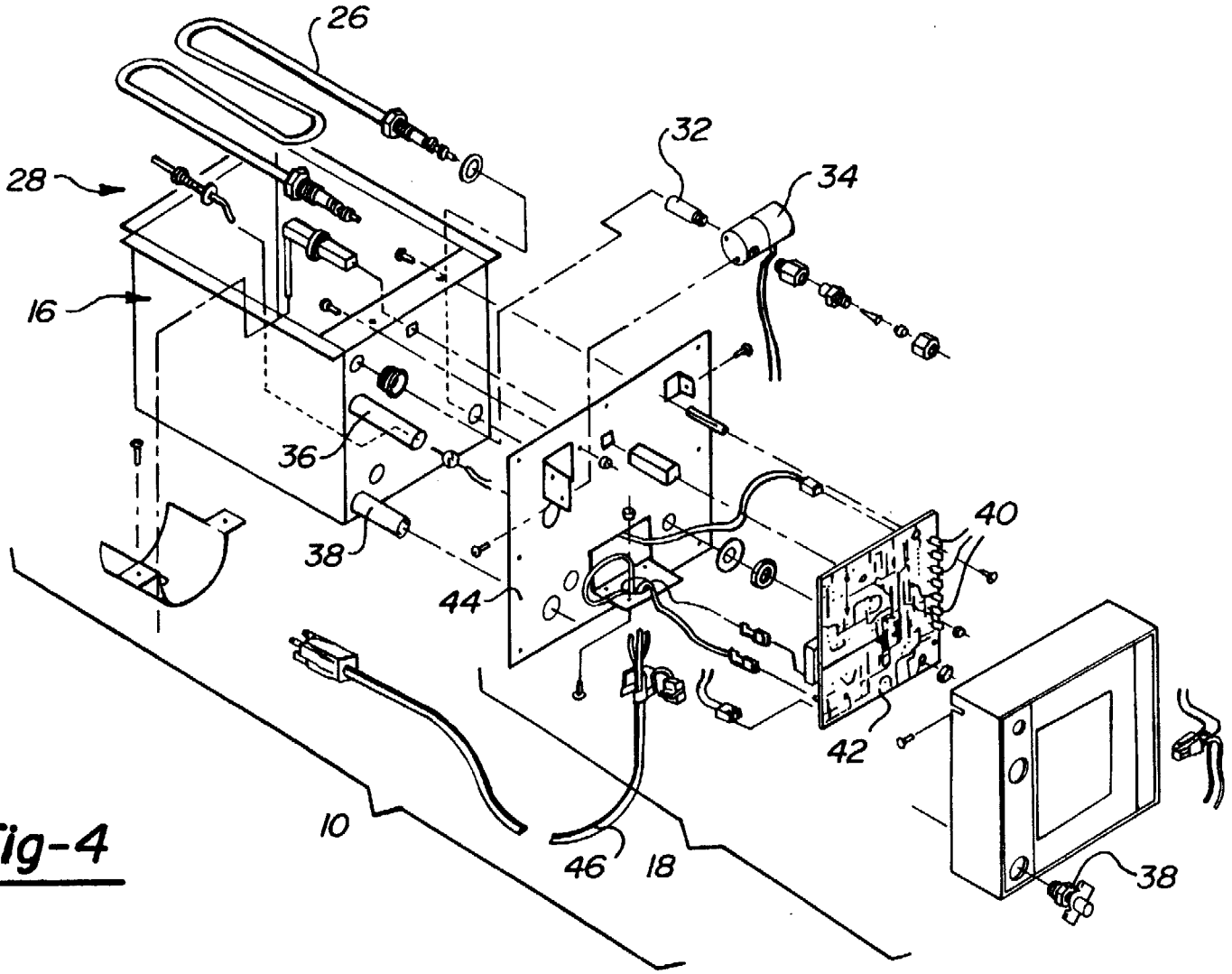
FIG. 4 is an exploded view of the humidifier.

The control housing 18 is mounted to the outer end of the humidifier 10 and houses the electronic circuitry and controls which ensure efficient and reliable operation of the humidifier 10. The face of the control housing 18 includes the water inlet 32 which is connected to a convenient water supply, the overflow 36 which should be directed to a waste drain, and a water drain 38 which is used to drain the reservoir 16 for maintenance purposes. The face of the control housing 18 also includes a series of indicators 40 which signal the various operating stages and troubleshooting states of the humidifier 10. In a preferred embodiment, the indicators are LEDs mounted directly to a circuit board 42 housed within the control housing 18. As shown in FIG. 4, the circuit board 42 is mounted to a back panel 44 of the control housing 18 and electronically connected to the various probes and elements as heretofore described in order to control operation of the humidifier 10. A power cord 46 is connected to the control housing 18 to provide the necessary power for the humidifier 10.

Figure 5A:
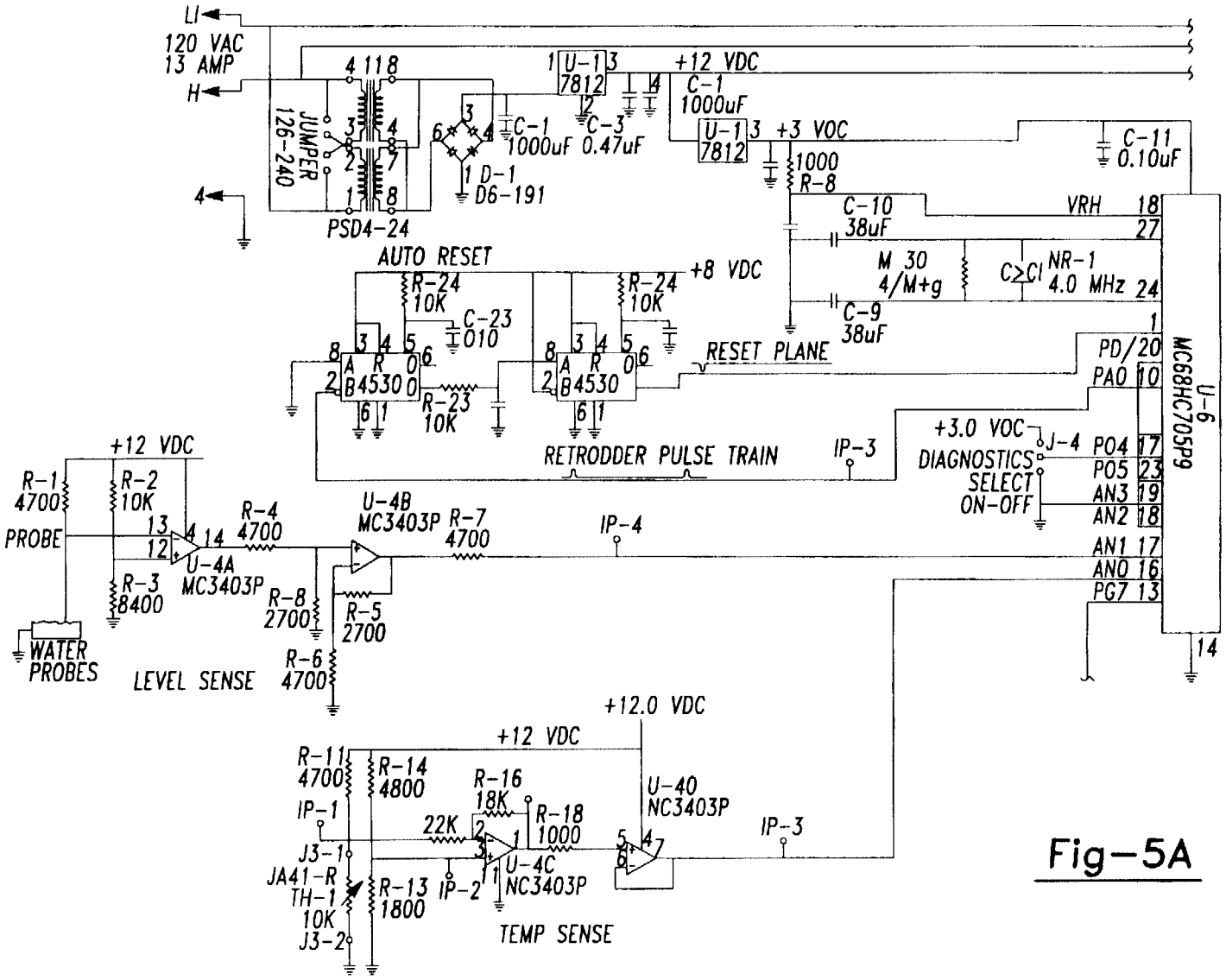
FIG. 5 is a diagram of the control circuit for the humidifier.
Figure 5B:
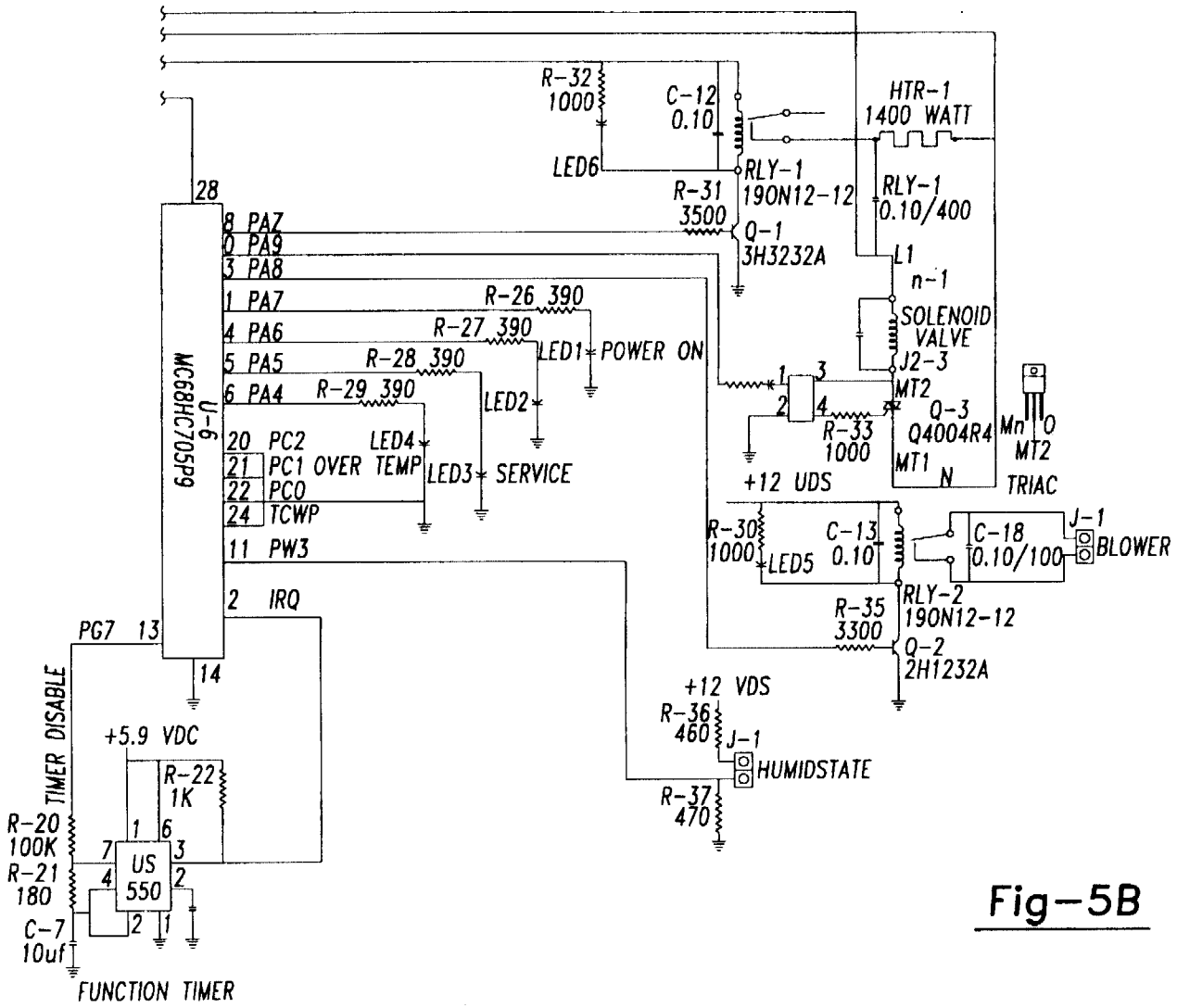

A schematic of the humidifier control circuit 50 imbedded on the circuit board 42 is shown in FIG. 5. The functions of the circuit 50 are processed through a microprocessor 52 which ensures nearly instantaneous reaction to specific operating states of the humidifier 10. In electronic communication with the microprocessor 52 are a water level sensing circuit 54 connected to the level probe 30, a temperature sensing circuit 56 connected to the temperature probe 28, a timer circuit 58 which controls the timing of humidifier functions, a circuit 60 for the humidistat 24, a circuit 62 for controlling the furnace blower, and flow control circuit 64 which controls the fill valve 34 for filling the reservoir 16. A reset circuit 66 is also provided to reset the processor 52 following correction of some error state of the microprocessor 52. The processor 52 controls the LED indicators 40 in accordance with signals received from the subcircuitry to identify the various operating states of the humidifier 10.

Figure 6A:
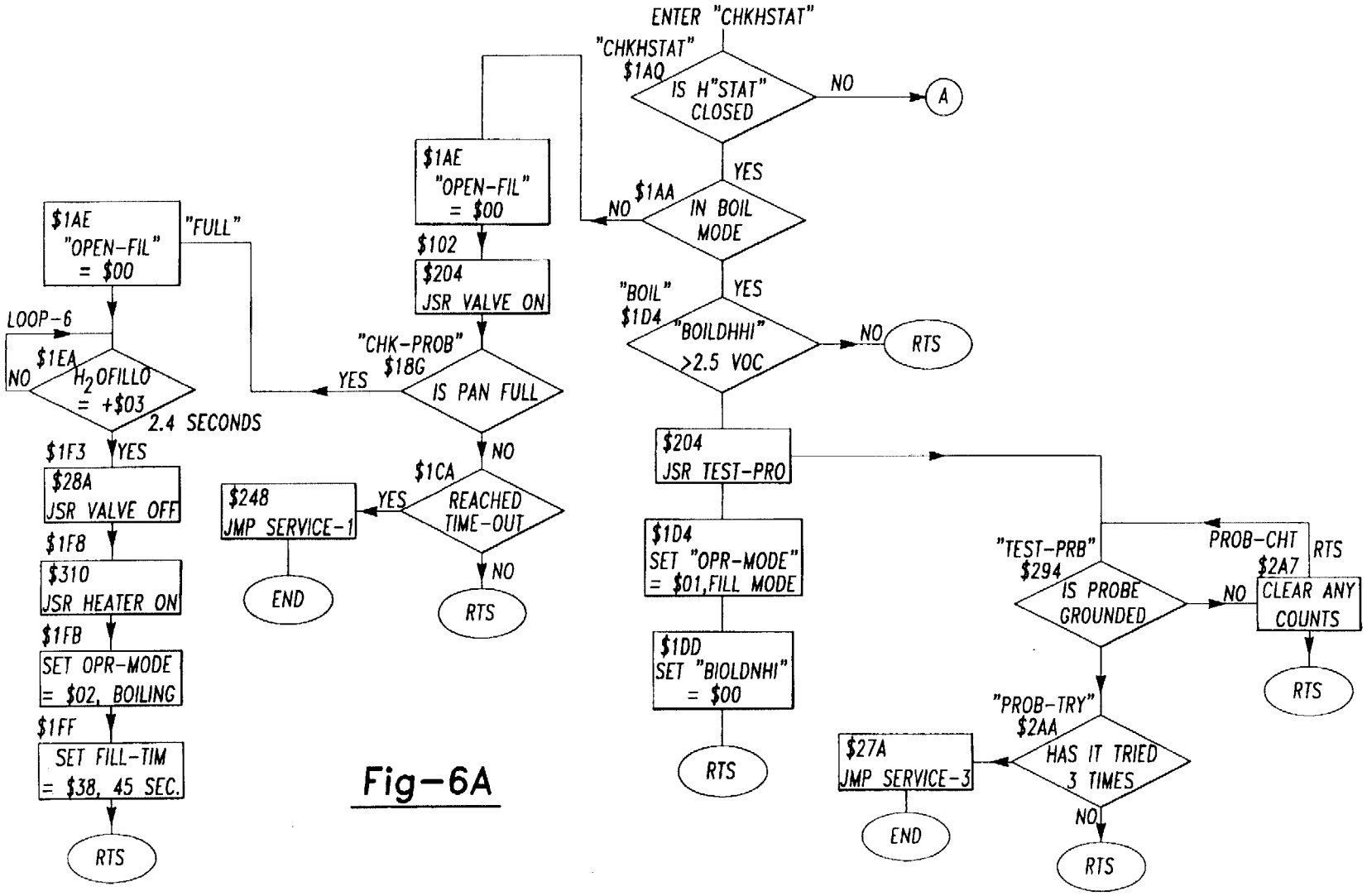
FIGS. 6A and 6B is a flow chart representing the operation of the humidifier.
Figure 6B:
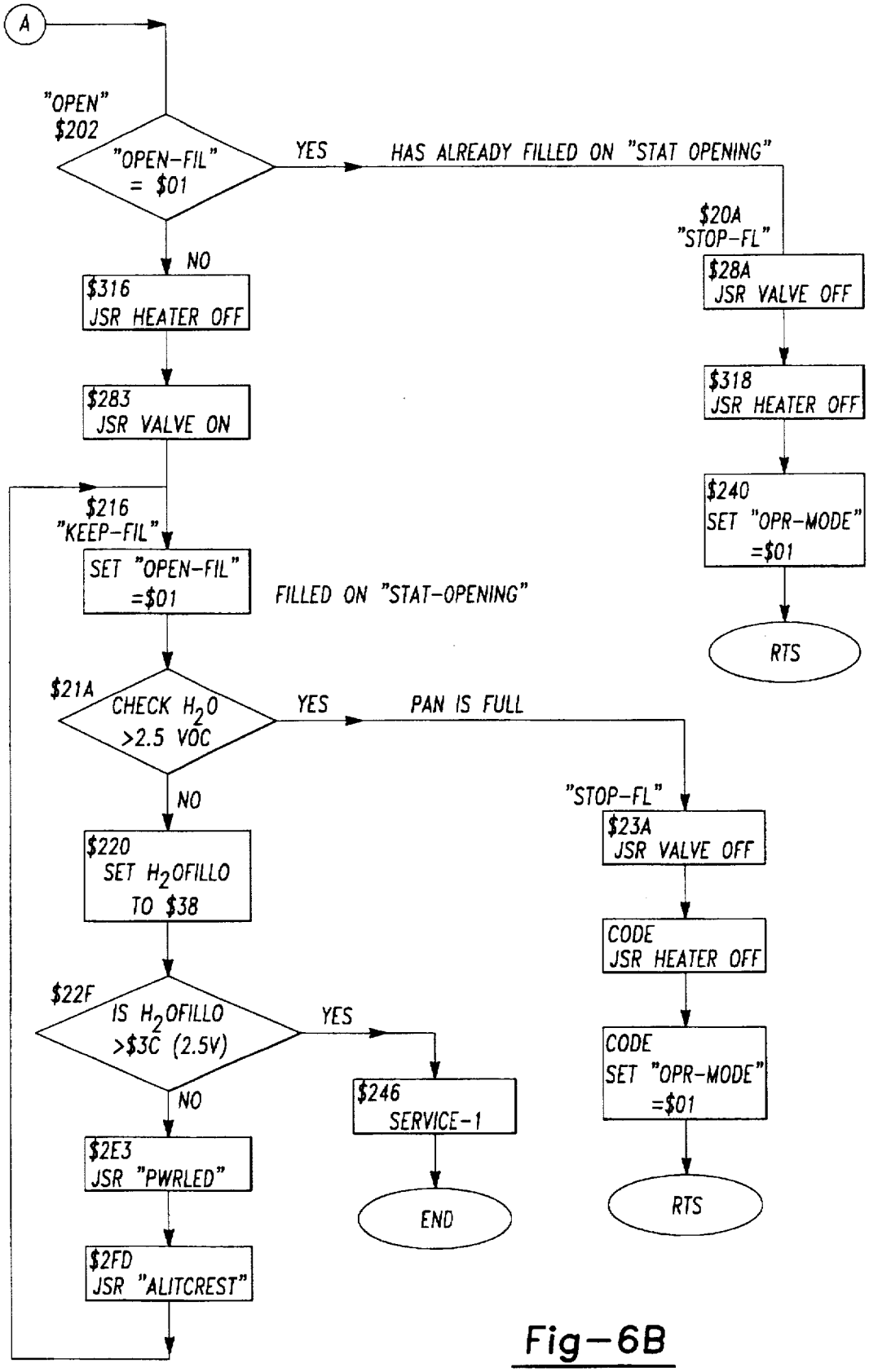

A portion of the microprocessor controlled operation of the humidifier 10 occurs in accordance with the flow chart of FIGS. 6A and 6B identifying the logic states of the processor 52 and commands issued to the subcircuits of the humidifier control circuit 54. The microprocessor 52 is programmed at the factory to control operation.

General operation of the humidifier 10 will now be described. Once the humidifier 10 has been installed in the heating duct 12 and the water inlet 32, humidistat 24, and blower control circuit 64 have been connected, the water supply and humidistat can be turned on. A "POWER" LED should slowly flash and a "WATER ON" LED should be illuminated to indicate that the reservoir 16 is being filled. When the water level has reached the desired level as measured by the probe 30, the fill valve 34 will be closed turning the WATER-ON lamp off. At this point a HUMIDIFIER lamp will illuminate and the heater element 26 will be turned on. The water in the reservoir 16 will boil down about 0.50 inch before refilling. The boil down is controlled by timing from the point the upper water level is reached and accrued only when the heater element 26 and furnace blower are on. This boil down cycle boils off about 25 cubic inches of water which takes approximately 15 minutes. The BLOWER-ON lamp and relay are energized at a water temperature of about 160° F., the point at which vapor may start to be generated, requiring the furnace blower to initiate operation in order to prevent condensation in the air ducts. At the end of a humidifying cycle, when the humidistat is opened to stop humidification, the heater element 26 will be de-energized.

The humidifier 10 is shut down preferably once per day for approximately one hour to allow the water to cool. Deposits on the heater element 26 will crack-off during the next humidifying cycle. During this period the CYCLE-OFF LED will be illuminated and no humidifying functions are performed.

As a precaution, an OVER TEMP lamp will be illuminated if the reservoir temperature rises above a predetermined temperature. In this state, the water valve 34, the blower relay 62 and the heater element 26 will be shut down. The SERVICE LED will flash to indicate that service of the humidifier 10 is necessary.

Operation of the humidifier 10 will now be described in greater detail in conjunction with the flow chart of FIGS. 6A and 6B. The first step in the CHKHSTAT routine is to check the humidistat 24 to see if it is open or closed. If the humidistat 24 is closed calling for humidity, the program checks whether the humidifier is in a "boiling" mode and if boiling has occurred for more than about eleven minutes, the boiling time allowed before refilling the reservoir 16 with more water. During the check on boiling inquiry, if the humidistat 24 has closed since the last check, the reservoir is filled in order to ensure enough water for eleven minutes of boiling during the next cycle. When the eleven minute boil down period has ended, the water probe 30 is tested to determine if it is indicating a full condition. Since the water should have been boiled down indicating a not-full condition, if the probe 30 still indicates full after a second eleven minute period of boiling the probe 30 is considered to be electrically grounded and a service mode is initiated.

During filling of the reservoir 16, the water probe 30 is checked for the first indication of water reaching the probe 30. With the first contact a timer is started allowing continued filling for about 2.4 seconds. At normal water pressures, this extra time allows the water to rise to the probe 30 as opposed to bubbles or foam which could indicate a fill condition resulting in a lower water level. During the fill operation, another 45 second timing function is started which if reached will cause a service function since the water level should reach the probe 30 well before the end of this timing period.

If the humidistat circuit 60 is open during the first program pass, the heater 26 is turned off yet the fill valve 34 is not closed in order to fill the reservoir 16 with cold water. This cools the reservoir and reduces the vapor output that would otherwise continue from the near boiling water reducing condensation in the duct and furnace. This first program pass sets a flag in memory in order to bypass this function after the reservoir 16 is filled with water.

While the CHKHSTAT routine is the major function of the microprocessor program the main program loop incorporates six subroutines for operation of the humidifier:

CHKOURTEMP—checks the temperature probe for a temperature in excess of about 230° F. indicating that the water level has boiled down to where the heater is not in the water. A service routine is initiated causing the OVER TEMP LED is flashed and the humidifier 10 is shut down.

CHKBLOTMP—checks the reservoir water temperature and closes the blower relay to control the furnace fan. The fan will be energized at about 160° F.

CHKTOD—reads several memory locations incremented at certain intervals which control water filling, boiling times and shut down for cooling.

PWRLED—blinks the POWER LED indicating power is applied.

AUTOREST—controls operation in response to spikes or other interference which can result in loss of control of the humidifier by the microprocessor.

CHKHSTAT—the main control portion of the microprocessor program which performs the decision making steps for operation of the humidifier 10.

The microprocessor control of the humidifier 10 facilitates efficient operation in conjunction with the blower fan of the furnace system. Only when the water in the reservoir 16 has been heated to create steam vapor is the blower allowed to energize delivering humidified heat throughout the system. The microprocessor control also enables features which improve long-term reliability of the humidifier 10 such as the once-a-day shut down to allow cooling for scale build-upon on the heater to crack-off the element. Timing functions controlled by the microprocessor also enhance the reliability of the humidifier 10. By continuing to fill the reservoir 16 for a specified period of time even after the water reaches the probe 30, false water levels are avoided which may be caused by foam or bubbles on the surface of the water. Additionally, by filling the reservoir 16 after turning the heater element off following the humidifying cycle, the reservoir is cooled instantly reducing the vapor output that would otherwise continue. Thus, the present invention provides a reliable and efficient system for maximizing the humidity introduced to the heating system.

The foregoing detailed description has been given for clearness of understanding only and no unnecessary limitations should be understood therefrom as some modifications will be obvious to those skilled in the art without departing from the scope and spirit of the appended claims.

What is claimed is:

1. A humidifier for delivering moisture to a heating system, said humidifier adapted to be mounted within a duct of the heating system for direct communication with the airflow of the system, said humidifier comprising:

a fluid reservoir for holding a quantity of fluid to introduce moisture to the heating system, said reservoir having a fluid inlet with valving means to control the flow of fluid into said reservoir and a fluid level probe for monitoring the level of fluid within said reservoir;

a heater element positioned within said reservoir to heat the fluid creating a fluid vapor introduced into the heating system; and a control circuit incorporating a microprocessor for monitoring and controlling a plurality of frictional states of said humidifier during operation, said microprocessor programmed to measure at least one operating parameter of said humidifier including the fluid level within said reservoir, the temperature within said fluid reservoir and humidity levels resulting from operating of said humidifier and at least one control operation of said humidifier in response to predetermined operating state of said humidifier including maintaining said valving means open for a predetermined timing period following receipt of a reservoir fill signal to ensure a predetermined fluid level within said reservoir, energizing said heater element to humidify the air of the heating system, operation of a fan blower of the heating system and preventing operation of said humidifier for a predetermined time period to facilitate removal of mineral deposits within said reservoir, said microprocessor electronically connected to at least one subcircuit of said control circuit including a subcircuit measuring operating parameters of said humidifier, a subcircuit responding to electronic communication from said microprocessor and a timing subcircuit for timing operations of at least one subcircuit associated with said microprocessor.

2. The humidifier as defined in claim 1 wherein said microprocessor signals said valving means to remain open for a predetermined timing period measured by said timing subcircuit following receipt of a reservoir fill signal from said fluid level subcircuit to ensure a predetermined fluid level within said reservoir.

3. The humidifier as defined in claim 1 wherein said reservoir includes a probe for monitoring the temperature within said reservoir, said temperature probe electronically communicating with a temperature subcircuit in communication with said microprocessor.

4. The humidifier as defined in claim 3 wherein said heater element electronically communicates with a heater subcircuit in communication with said microprocessor.

5. The humidifier as defined in claim 4 wherein said control circuit includes a fan subcircuit in communication with said microprocessor and a fan blower of the heating system, said microprocessor signalling said fan subcircuit to operate the fan blower in response to a signal from said temperature subcircuit that the temperature in said reservoir has attained a predetermined level.

6. The humidifier as defined in claim 1 and further comprising a humidistat for monitoring humidity levels, said humidistat electronically communicating with a humidistat subcircuit in communication with said microprocessor whereby operation of said humidifier is maintained in response to predetermined humidity levels.

7. The humidifier as defined in claim 1 wherein said microprocessor prevents operation of said humidifier for a predetermined time period measured by said timing circuit to facilitate removal of mineral deposits within said reservoir.

8. The humidifier as defined in claim 1 and further comprising indicator means on said humidifier identifying the operating states of said humidifier, said indicator means electronically connected and controlled by said microprocessor.

9. A humidifier for delivering moisture to a heating system, said humidifier adapted to be mounted within a duct of the heating system for direct communication with the airflow of the system, said humidifier comprising:

a fluid reservoir for holding a quantity of fluid to introduce moisture to the heating system, said reservoir having a fluid inlet with valving means to control the flow of fluid into said reservoir and a fluid level probe for monitoring the level of fluid within said reservoir;

a heater element positioned within said reservoir to heat the fluid crating a fluid vapor introduced into the heating system; and a control circuit incorporating a microprocessor for monitoring and controlling a plurality of functional states of the humidifier during operation, said microprocessor programmed to measure at least one operating parameter of said humidifier including the fluid level within said reservoir and at least one control operation of said humidifier in response to a predetermined operating state of said humidifier for including said valving means for filling said reservoir and energizing said heater element to humidify the air of the heating system;

said microprocessor forming a portion of said control circuit is electronically connected to at least one subcircuit of said control circuit;

a subcircuit measuring operating parameters of said humidifier;

a subcircuit responding to electronic communications from said microprocessor; and a timing subcircuit for timing operations of said subcircuits associated with said microprocessor whereby said microprocessor signals said valve means to remain open for a predetermined timing period measured by said timing subcircuit following receipt of a reservoir fill signal from said fluid level subcircuit to ensure a predetermined fluid level within said reservoir, said microprocessor energizing said heater element to humidify the air of the heating system, said microprocessor selectively preventing operation of said humidifier for a predetermined time period measured by said timing subcircuit to facilitate removal of mineral deposits within said reservoir.

10. The humidifier as defined in claim 9 wherein said reservoir includes a probe for monitoring the temperatures within said reservoir, said temperature probe electronically communicating with a temperature subcircuit in communication with said microprocessor.

11. The humidifier as defined in claim 10 wherein said heater element electronically communicates with a heater subcircuit in communication with said microprocessor.

12. The humidifier as defined in claim 11 wherein said control circuit includes a fan subcircuit in communication with said microprocessor and a fan blower of the heating system, said microprocessor signalling said fan subcircuit to operate the fan blower in response to a signal from said temperature subcircuit that the temperature in said reservoir has attained a predetermined level.

13. The humidifier as defined in claim 9 and further comprising a humidistat for monitoring humidity levels, said humidistat electronically communicating with a humidistat subcircuit in communication with said microprocessor whereby operation of said humidifier is maintained in response to predetermined humidity levels.

14. The humidifier as defined in claim 9 and further comprising indicator means on said humidifier identifying the operating states of said humidifier, said indicator means electronically connected and controlled by said microprocessor.

* * * * *